US007484550B2

(12) United States Patent
Blejde et al.

(10) Patent No.: US 7,484,550 B2
(45) Date of Patent: Feb. 3, 2009

(54) CASTING STEEL STRIP

(75) Inventors: Walter N. Blejde, Brownsburg, IN (US); Rama Ballav Mahapatra, Indianapolis, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 11/052,408

(22) Filed: Feb. 7, 2005

(65) Prior Publication Data

US 2005/0145304 A1 Jul. 7, 2005

Related U.S. Application Data

(60) Division of application No. 10/436,336, filed on May 12, 2003, which is a continuation-in-part of application No. 10/350,777, filed on Jan. 24, 2003, now abandoned.

(51) Int. Cl.
*B22D 11/06* (2006.01)
*C22C 38/00* (2006.01)

(52) U.S. Cl. ..... 164/480; 148/320

(58) Field of Classification Search ..... 164/480, 164/418, 428; 148/320
See application file for complete search history.

(56) References Cited

U.S. PATENT DOCUMENTS

| | | | |
|---|---|---|---|
| 4,073,643 | A | 2/1978 | Kumai et al. |
| 4,152,140 | A | 5/1979 | Hori et al. |
| 4,235,632 | A | 11/1980 | Uher et al. |
| 4,250,950 | A | 2/1981 | Buxmann et al. |
| 4,368,084 | A | 1/1983 | Irie et al. |
| 4,746,361 | A | 5/1988 | Pielet et al. |
| 4,851,052 | A | 7/1989 | Nishioka et al. |
| 5,227,251 | A | 7/1993 | Suichi et al. |
| 5,520,243 | A | 5/1996 | Freeman et al. |
| 5,535,812 | A | 7/1996 | Singleton |
| 5,588,479 | A | 12/1996 | Leadbeatter et al. |
| 5,701,948 | A | 12/1997 | Strezov et al. |
| 5,720,336 | A | 2/1998 | Strezov |
| 5,934,359 | A | 8/1999 | Strezov |
| 6,059,014 | A | 5/2000 | Strezov |
| 6,073,679 | A | 6/2000 | Strezov |
| 6,120,621 | A | 9/2000 | Jin et al. |
| 6,491,089 | B1 | 12/2002 | Poirier et al. |
| 6,558,486 | B1 | 5/2003 | Strezov et al. |
| 2003/0000679 | A1 | 1/2003 | Strezov et al. |

(Continued)

FOREIGN PATENT DOCUMENTS

| | | | |
|---|---|---|---|
| EP | 0 800 881 | A2 | 10/1997 |

(Continued)

OTHER PUBLICATIONS

"Scanning Electron Microscopy and X-Ray Microanalysis", A Text for Biologists, Materials Scientists, and Geologists, Second Edition, 1992, Chapter 8.

(Continued)

*Primary Examiner*—Kevin P Kerns
(74) *Attorney, Agent, or Firm*—Hahn Loeser & Parks, LLP

(57) ABSTRACT

A molten steel having a slag of iron, manganese, silicon and aluminum oxides is formed and passed between a pair of casting rolls to form the steel strip having $MnO.SiO_2.Al_2O_3$ inclusions, the inclusions having a desired ratio of $MnO/SiO_2$.

5 Claims, 13 Drawing Sheets

U.S. PATENT DOCUMENTS

| | | | |
|---|---|---|---|
| 2003/0111206 | A1 | 6/2003 | Blejde et al. |

FOREIGN PATENT DOCUMENTS

| | | | | |
|---|---|---|---|---|
| FR | 1 364 717 | | | 5/1964 |
| JP | 51-67227 | | | 6/1976 |
| JP | 3-128149 | A | | 5/1991 |
| JP | 4-41052 | A | | 2/1992 |
| JP | 6-594 | | * | 1/1994 |
| JP | 06-594 | A | | 1/1994 |
| JP | 6-40650 | A | | 2/1994 |
| JP | 6-134553 | A | | 5/1994 |
| JP | 8-294751 | A | | 11/1996 |
| JP | 2000-178634 | | * | 6/2000 |
| JP | 2000-178634 | A | | 6/2000 |
| JP | 2003-326342 | | | 11/2003 |
| WO | 95/13889 | A1 | | 5/1995 |
| WO | WO98/55251 | | | 12/1998 |
| WO | WO 00/07753 | | | 2/2000 |
| WO | WO 03/024644 | | | 3/2003 |

OTHER PUBLICATIONS

Ginzurg, V. and Ballas, R.; Flat Rolling Fundamentals; Marcel Decker, Inc., New York, NY; pp. 50-52.

* cited by examiner

CASTING STEEL STRIP

CROSS REFERENCE TO RELATED APPLICATIONS

This application is a division of U.S. patent application Ser. No. 10/436,336, filed May 12, 2003, which is a continuation in part of U.S. patent application Ser. No. 10/350,777, filed Jan. 24, 2003, which is now abandoned.

BACKGROUND

This invention relates to the casting of steel strip in a twin roll caster.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

When casting steel strip in a twin roll caster the casting pool will generally be at a temperature in excess of 1550° C. and it is necessary to achieve very rapid and even cooling of the molten steel over the casting surfaces of the rolls in order to obtain solidification in the short period of exposure of each point on the casting surfaces to the molten steel casting pool during each revolution of the casting rolls. As described in U.S. Pat. No. 5,720,336 the heat flux on solidification can be dramatically affected by the nature of the metal oxides which are deposited on the casting roll surfaces from the steel slag which forms on the casting pool during the casting process. Specifically heat flux on solidification can be greatly enhanced if the metal oxides thus deposited on the casting surfaces are in liquid form at the casting temperature thus ensuring that the casting surfaces are each covered by a layer of material which is at least partially liquid at the solidification temperature of the steel. The oxides solidify with the steel to form oxide inclusions in the steel strip but it is most important that they remain in liquid form at the initial solidification temperature of the steel so that they do not deposit as solid particles on the casting surfaces prior to solidification of the steel and thereby inhibit heat transfer to the molten steel.

SUMMARY OF THE INVENTION

Based on experience in casting low carbon steel strip in a twin roll caster and analyzing the oxide inclusions formed when casting steels of differing compositions, we have discovered that the heat fluxes at the casting surfaces are governed by the melting point of inclusions produced from two sources, namely (a) those produced during solidification at the meniscus on initial solidification of the steel on the casting surfaces and (b) those produced during deoxidation of liquid steel in the ladle.

In the solidification of the strip on the casting rolls, the solidification inclusions are localized at the surfaces of the strip. On the other hand, the deoxidation inclusions formed in the ladle are distributed throughout the strip and are markedly coarser than the solidification inclusions. Both sources of inclusions are important to the casting of the strip, and for better casting conditions, the melting points of the inclusions produced from both sources should be low.

The disclosure of U.S. Pat. No. 5,720,336 was concerned exclusively with the inclusions generated during the solidification. It was assumed in that disclosure that the presence of $Al_2O_3$ in the slag is necessarily detrimental and should be minimized or counteracted by calcium treatment. However, we have now found, to the contrary, that the presence of controlled amounts of $Al_2O_3$ in the deoxidation inclusions can be highly beneficial in ensuring that the inclusions remain molten until the surrounding steel melt has solidified during casting. With manganese/silicon killed steel, the inclusion melting point is very sensitive to changes in the ratio of manganese oxides to silicon oxides, and for some such ratios, the inclusion melting point may be quite high, e.g., greater than 1700° C., which can prevent the formation of a satisfactory liquid film on the casting roll surfaces and may lead to clogging of flow passages in the molten steel delivery system. The deliberate generation of $Al_2O_3$ in the deoxidation inclusions so as to produce a three phase oxide system comprising MnO, $SiO_2$ and $Al_2O_3$ can reduce the sensitivity of the inclusion melting point to changes in the $MnO/SiO_2$ ratios, and can actually reduce the melting point of the inclusions. The present invention accordingly provides for casting low carbon steel in a twin roll caster which allows for the formation of deoxidation inclusions including $Al_2O_3$.

According to the invention there is provided a method of casting low carbon steel strip comprising:

assembling a pair of casting rolls forming a nip between the rolls;

forming a molten steel having a slag of iron, manganese, silicon and aluminum oxides producing in a steel strip $MnO.SiO_2.Al_2O_3$ inclusions having a ratio of $MnO/SiO_2$ in the range of 0.2 to 1.6 and $Al_2O_3$ content less than 45%; and introducing the molten steel between the pair of casting rolls to form a casting pool of molten steel supported on casting surfaces of the rolls above the nip; and counter rotating the casting rolls to produce a solidified steel strip delivered downwardly from the nip.

The $Al_2O_3$ content in the inclusions in the molten steel is such as to permit the formation of liquid inclusions. The resulting $Al_2O_3$ content in the strip formed from the molten steel may range up to a maximum percentage of 35+2.9 (R−0.2), where R is the $MnO/SiO_2$ ratio of the inclusions. The $Al_2O_3$ content of the resulting strip may be in the range 10% to 30% over a wide range of $MnO/SiO_2$ ratios. The inclusions may contain at least 3% $Al_2O_3$.

The inclusions may be dispersed generally throughout the strip and the majority range in a size from 2 to 12 microns.

The invention also provides a cast low carbon steel strip of less than 5 mm thickness comprising solidified steel phases and distributed generally throughout the strip solidified $MnO.SiO_2.Al_2O_3$ inclusions having an $MnO/SiO_2$ ratio in the range 0.2 to 1.6 and an $Al_2O_3$ content in the range 3% to 45%. The deoxidation inclusions may have a size range of 2 to 12 microns.

A novel low carbon steel strip may be produced described by the above method by which it is produced.

BRIEF DESCRIPTION OF THE DRAWINGS

In order that the invention may be more fully explained, results of experimental work carried out to date will be described with reference to the accompanying drawings in which.

DETAILED DESCRIPTION OF THE DRAWINGS

Figure 1:
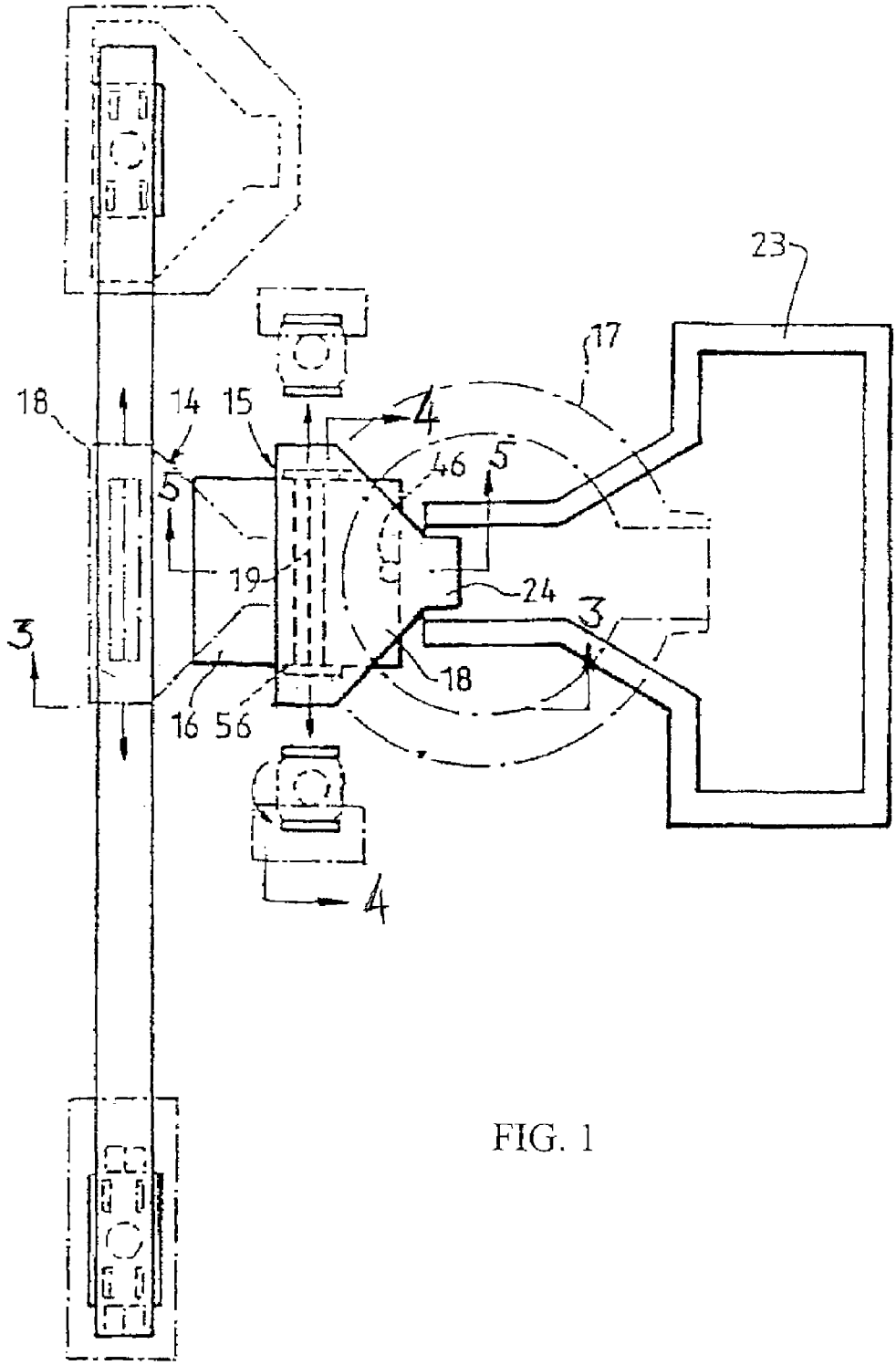
FIG. 1 is a plan view of a continuous strip caster which is operable in accordance with the invention.
Figure 2:
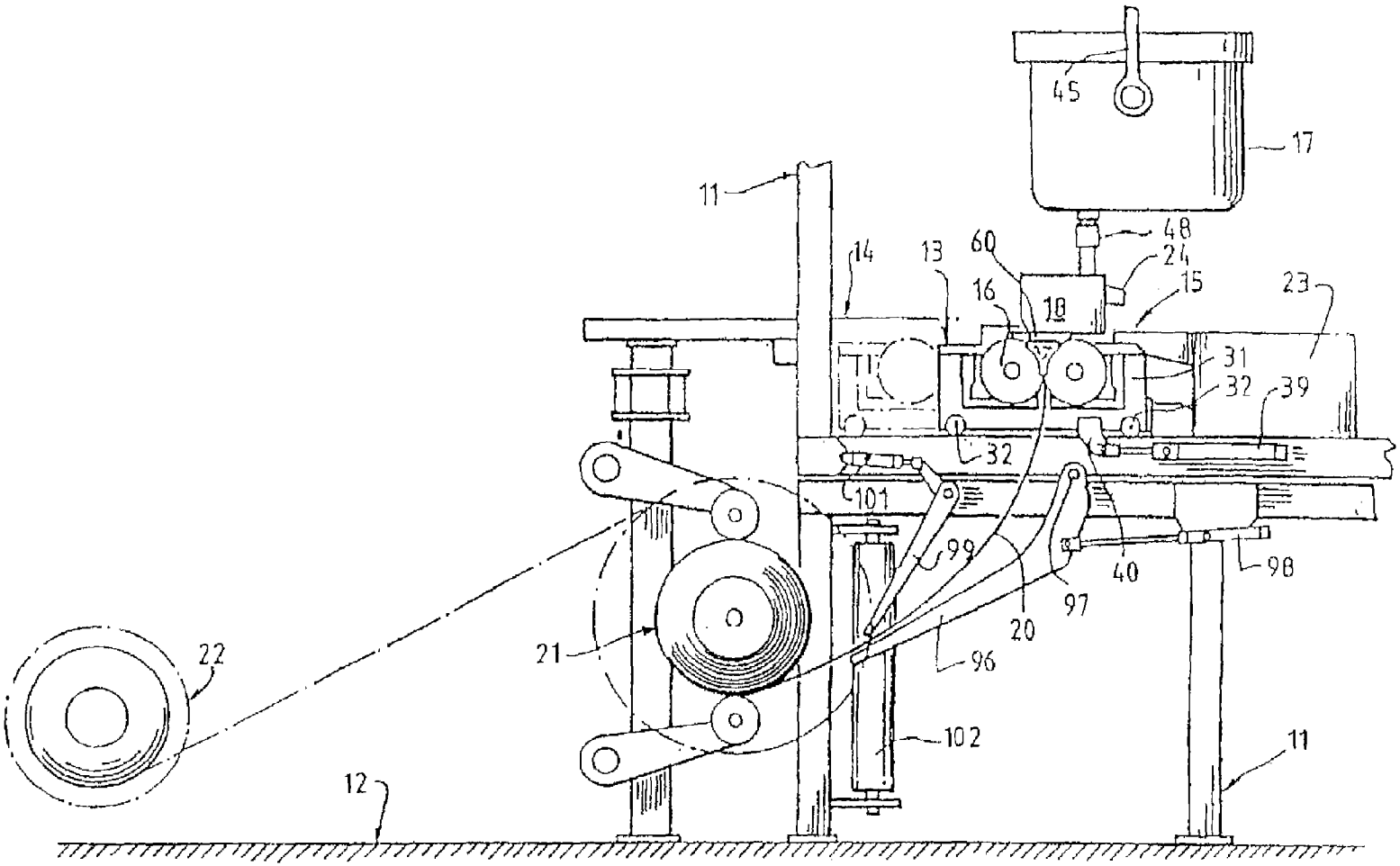
FIG. 2 is a side elevation of the strip caster shown in FIG. 1.
Figure 3:
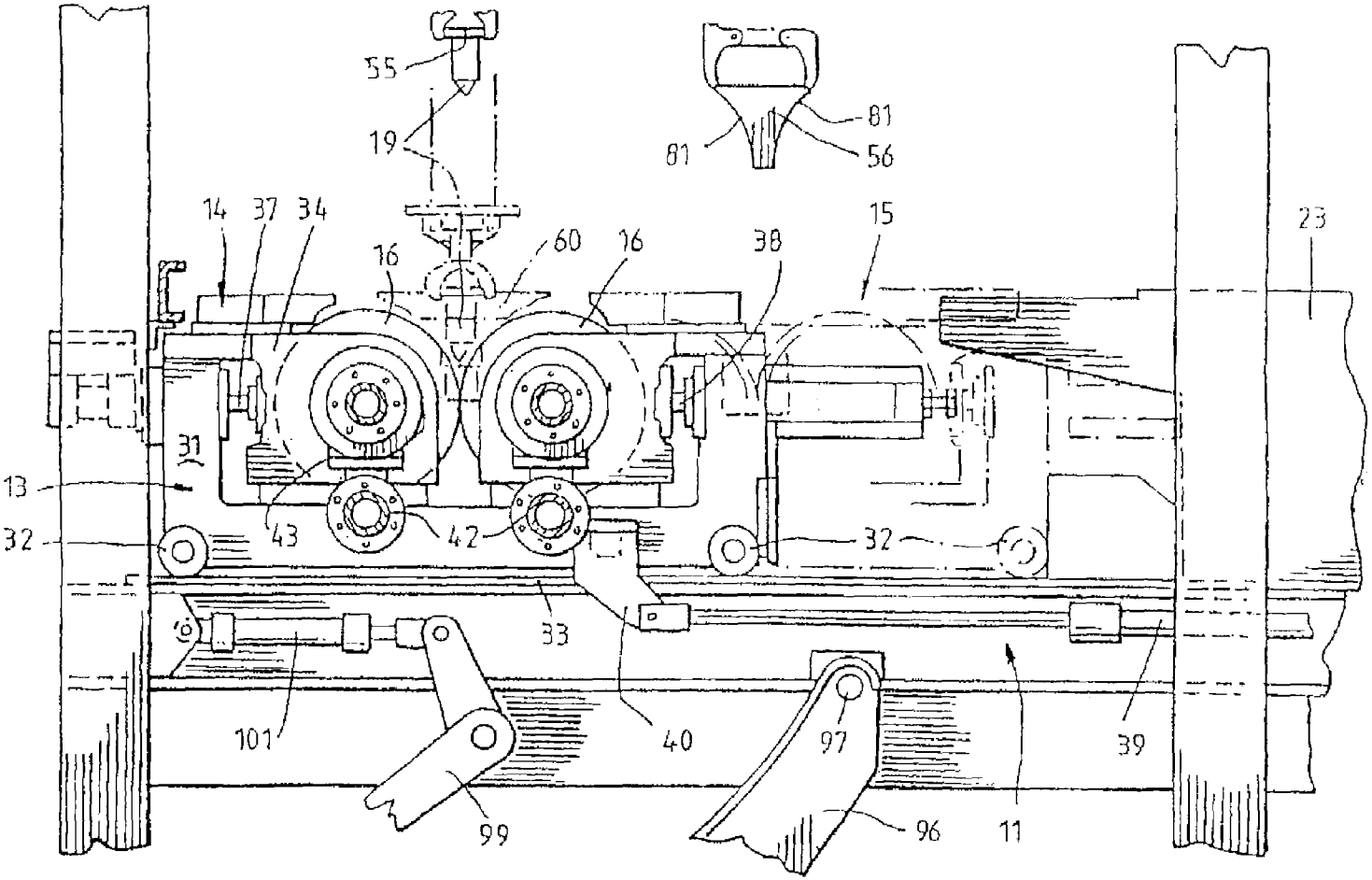
FIG. 3 is a vertical cross-section on the line 3—3 in FIG. 1.
Figure 4:
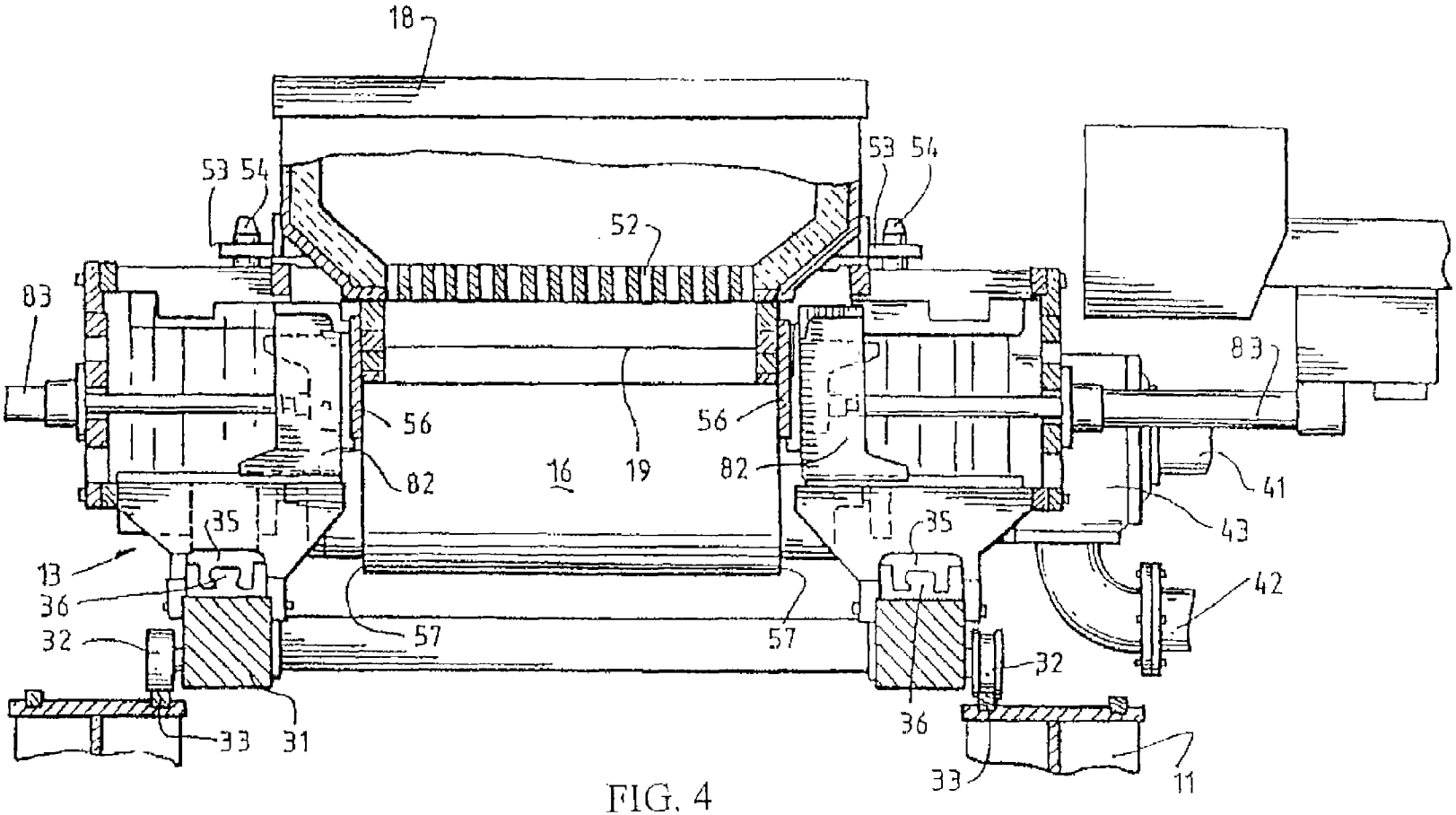
FIG. 4 is a vertical cross-section on the line 4—4 in FIG. 1.
Figure 5:
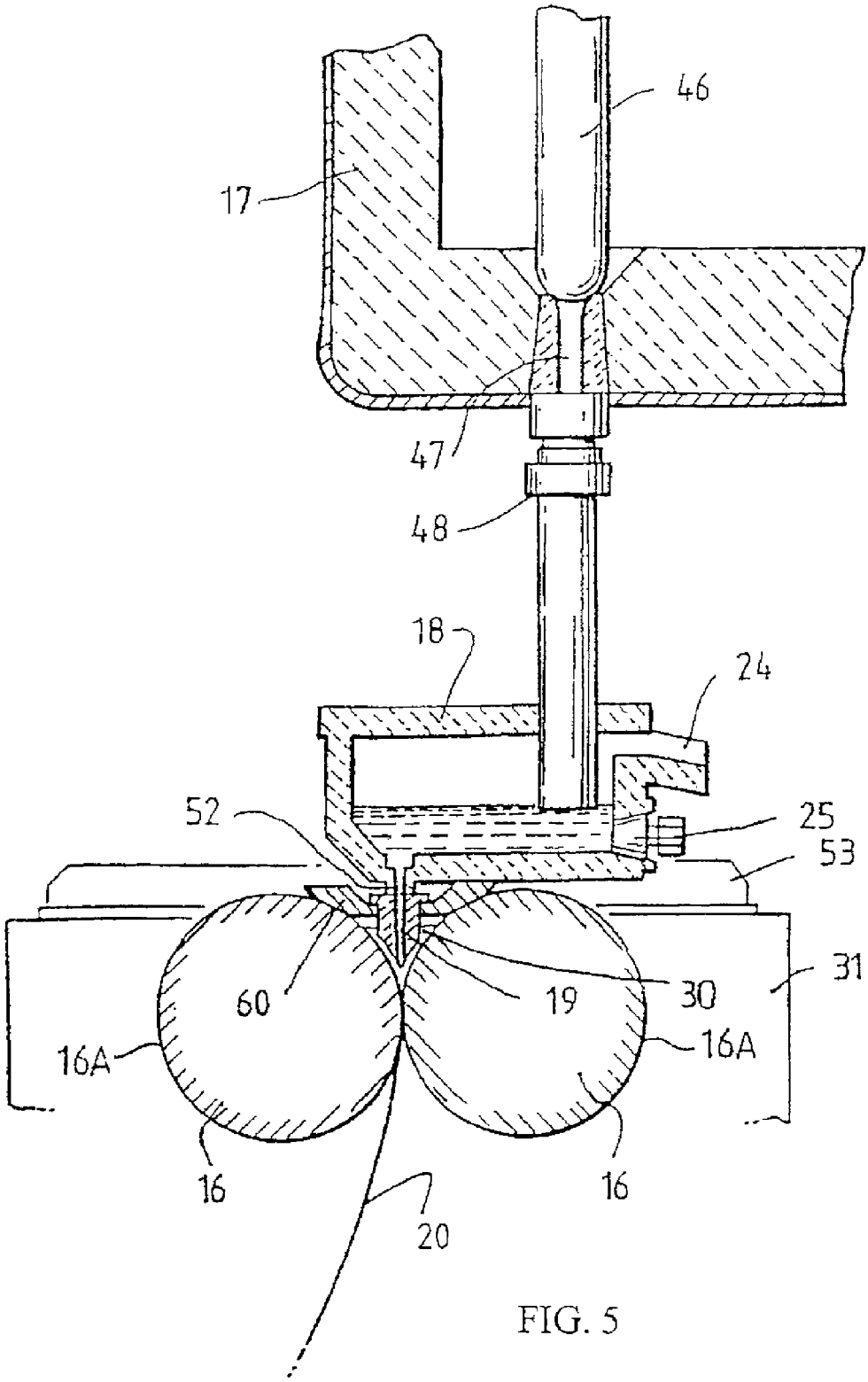
FIG. 5 is a vertical cross-section on the line 5—5 in FIG. 1.

FIGS. 1 to 5 illustrate a twin roll continuous strip caster which has been operated in accordance with the present invention. This caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a 35 ladle 17 via a tundish 18 and delivery nozzle 19 to create a casting pool 30. Casting rolls 16 are water cooled so that shells solidify on the moving roll surfaces 16A and are brought together at the nip between them to produce a solidified strip product 20 at the roll outlet. This product 20 is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other malfunction during a casting operation.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Roll cradles 34 are mounted on the carriage frame 31 by inter-engaging complementary slide members 35,36 to allow the cradles to be moved on the carriage under the influence of hydraulic cylinder units 37,38 to adjust the nip between die casting rolls 16 and to enable the rolls to be rapidly moved apart for a short time interval when it is required to form a transverse line of weakness across the strip as will be explained in more detail below. The carriage is movable as a whole along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm in diameter and up to 2000 mm, long in order to produce 2000 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as magnesium oxide (MgO). One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roll carriage frame 31 and provided with apertures to receive indexing pegs 54 on the carriage frame so as to accurately locate the tundish.

Delivery nozzle 19 is formed as an elongate body made of a refractory material such as alumina graphite. Its lower part is tapered so as to converge inwardly and downwardly so that it can project into the nip between casting rolls 16. It is provided with a mounting bracket 60 whereby to support it on the roll carriage frame and its upper part is formed with outwardly projecting side flanges 55 which locate on the mounting bracket.

Nozzle 19 may have a series of horizontally spaced generally vertically extending flow passages to produce a suitably low velocity discharge of metal throughout the width of the rolls and to deliver the molten metal into the nip between the rolls without direct impingement on the roll surfaces at which initial solidification occurs. Alternatively, the nozzle may have a single continuous slot outlet to deliver a low velocity curtain of molten metal directly into the nip between the rolls and/or it may be immersed in the molten metal pool.

The pool is confined at the ends of the rolls by a pair of side closure plates 56 which are held against stepped ends 57 of the rolls when the roll carriage is at the casting station. Side closure plates 56 are made of a strong refractory material, for example boron nitride, and have scalloped side edges 81 to match the curvature of the stepped ends 57 of the rolls. The side plates can be mounted in plate holders 82 which are movable at the casting station by actuation of a pair of hydraulic cylinder units 83 to bring the side plates into engagement with the stepped ends of the casting rolls to form end closures for the molten pool of metal formed on the casting rolls during a casting operation.

During a casting operation the ladle stopper rod 46 is actuated to allow molten metal to pour from the ladle to the tundish through the metal delivery nozzle whence it flows to the casting rolls. The clean head end of the strip product 20 is guided by actuation of an apron table 96 to the jaws of the coiler 21. Apron table 96 hangs from pivot mountings 97 on the main frame and can be swung toward the coiler by actuation of an hydraulic cylinder unit 98 after the clean head end has been formed. Table 96 may operate against an upper strip guide flap 99 actuated by a piston and a cylinder unit 101 and the strip product 20 may be confined between a pair of vertical side rollers 102. After the head end has been guided in to the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster.

Full particulars of a twin roll caster of the kind illustrated in FIGS. 1 to 5 are more fully described in our U.S. Pat. Nos. 5,184,668 and 5,277,243 and International Patent Application PCT/AU93/00593.

Figure 6:
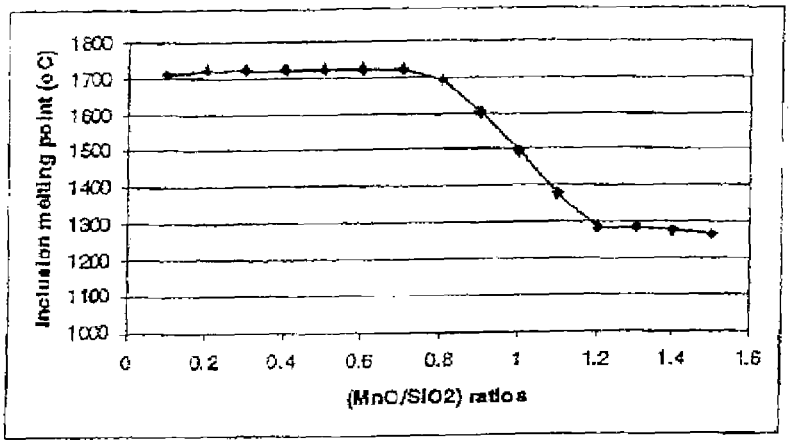
FIG. 6 illustrates the effect of $MnO/SiO_2$ ratios on inclusion melting point.

Extensive casting of manganese silicon killed low carbon steel strip in a twin roll caster has shown that the melting point of deoxidation inclusions is very sensitive to changes in the $MnO/SiO_2$ ratios for those inclusions. This is illustrated in FIG. 6 which plots variations in inclusion melting point against the relevant $MnO/SiO_2$ ratios. When casting low carbon steel strip the casting temperature is about 1580° C. It will be seen from FIG. 6 that over a certain range of $MnO/SiO_2$ ratios the inclusion melting point is much higher than this casting temperature and may be in excess of 1700° C. With such high melting points it is not possible to satisfy the requirement of ensuring the maintenance of a liquid film on the casting roll surfaces, and steel of this composition may not be castable. Furthermore, clogging of flow passages in the delivery nozzle and other parts of the steel delivery system can become a problem.

Although manganese and silicon levels in the steel can be adjusted with a view to producing the desired $MnO/SiO_2$ ratios, experience has shown that it is very difficult to ensure that the desired $MnO/SiO_2$ ratios are in fact achieved and maintained in practice in a commercial plant. For example, we have determined that a steel composition having a manganese content of 0.6% and a silicon content of 0.3% is a desirable chemistry and based on equilibrium calculations should produce a $MnO/SiO_2$ ratio greater than 1.2. However, our experience in operating a commercial roll casting plant has shown that much lower $MnO/SiO_2$ ratios are obtained. This is illustrated by FIG. 7 in which $MnO/SiO_2$ ratios obtained from inclusion analysis carried out on steel samples taken at various locations in a commercial scale strip caster during casting of MO6 steel strip, the various locations being identified as follows:

| | |
|---|---|
| L1: | ladle |
| T1, T2, T3: | a tundish which receives metal from the ladle. |
| TP2, TP3: | a transition piece below the tundish. |
| S, 1, 2: | successive parts of the formed strip. |

Figure 7:
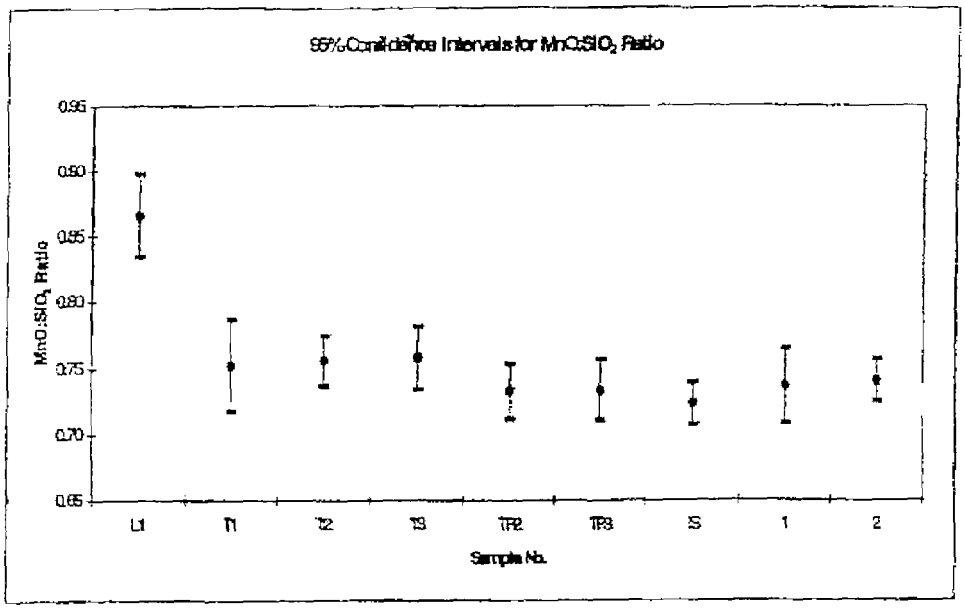
FIG. 7 illustrates $MnO/SiO_2$ ratios obtained from inclusion analysis carried out on samples taken from various locations in a strip caster during the casting of low carbon steel strip.

It will be seen from FIG. 7 that the measured $MnO/SiO_2$ ratios are all considerably lower than the calculated expected ratio of more than 1.2. Moreover small changes in $MnO/SiO_2$ ratio, for example a reduction from 0.9 to 0.8, can increase the melting point considerably as seen in FIG. 6. Also, during steel transfer operation from the ladle to the mould, steel exposure to air will cause re-oxidation which will tend to further reduce the $MnO/SiO_2$ ratios (Si has more affinity for oxygen compared to Mn for oxygen, and therefore, more $SiO_2$ will be formed, lowering the ratio). This effect can clearly be seen in FIG. 7 where the $MnO/SiO_2$ ratios in the tundish (T1, T2, T3), transition piece (TP2, TP3) and strip (S, 1, 2) are lower than in the ladle (L1).

We have found that by introducing controlled alumina levels, $MnO.SiO_2.Al_2O_3$ based inclusions can produce the following benefits: lower inclusion melting point (particularly at lower values of $MnO/SiO_2$ ratios); and reduced sensitivity of inclusion melting point to changes in $MnO/SiO_2$ ratios.

Figure 8:
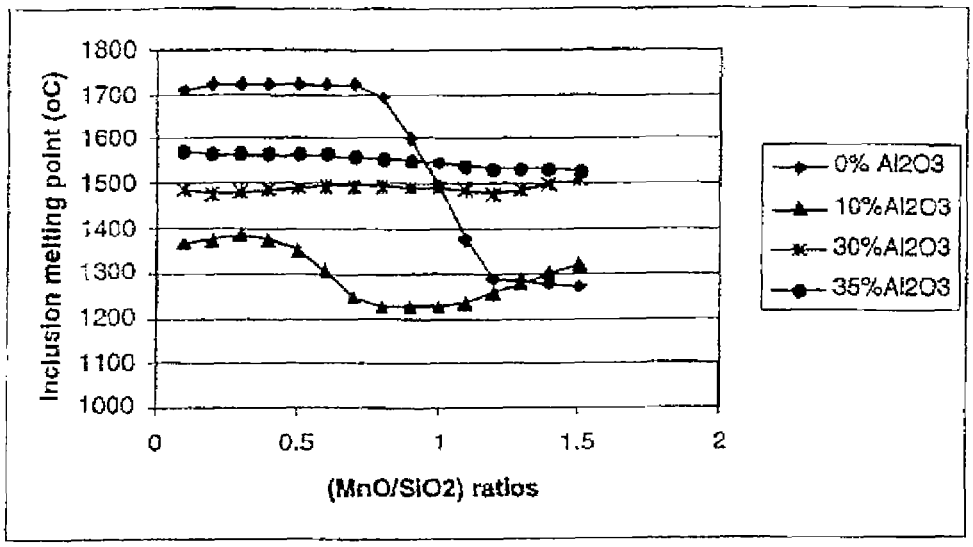
FIG. 8 illustrates the effect on inclusion melting point by the addition of $Al_2O_3$ at varying contents.
Figure 9:
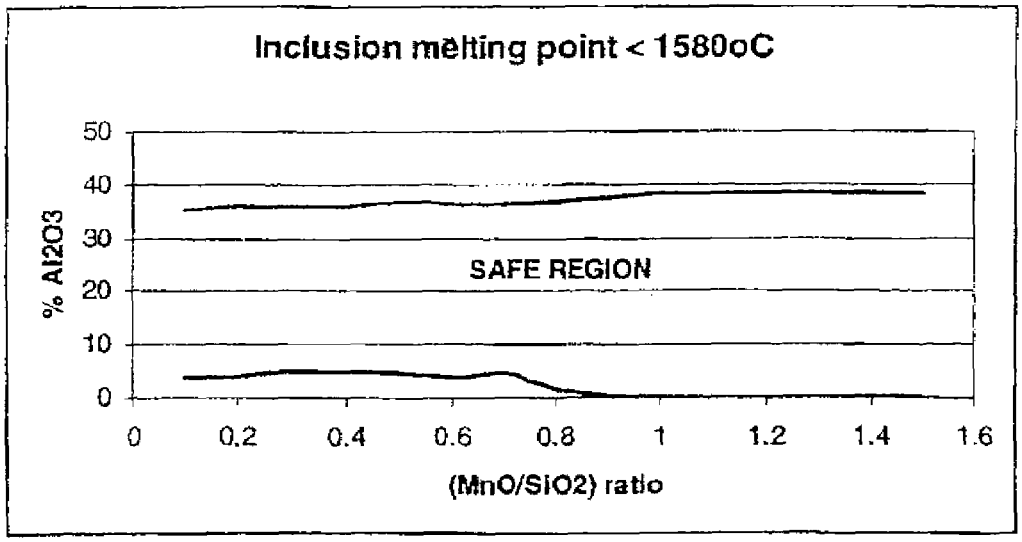
FIG. 9 illustrates how $Al_2O_3$ levels may be adjusted within a safe operating region when casting low carbon steel in order to keep the melting point of the oxide inclusions below a casting temperature of about 1580° C.

These benefits are illustrated by FIG. 8, which plots measured values of inclusion melting point for differing $MnO/SiO_2$ ratios with varying $Al_2O_3$ content in the inclusions. These results show that low carbon steel of varying $MnO/SiO_2$ ratios can be made castable with proper control of $Al_2O_3$ levels. This is further shown by FIG. 9 which shows the range of $Al_2O_3$ contents for varying $MnO/SiO_2$ ratios which will ensure an inclusion melting point of less than 1580° C., which is a typical casting temperature for a silicon manganese killed low carbon steel. It will be seen that the upper limit of $Al_2O_3$ content ranges from about 35% for an $MnO/SiO_2$ ratio of 0.2 to about 39% for an $MnO/SiO_2$ ratio of 1.6. The increase of this maximum is approximately linear and the upper limit or maximum $Al_2O_3$ content can therefore be expressed as 35+2.9 (R−0.2).

For $MnO/SiO_2$ ratios of less than about 0.9 it is essential to include $Al_2O_3$ to ensure an inclusion melting point less than 1580° C. A minimum of about 3% $Al_2O_3$ is essential and a reasonable minimum would be of the order of 10% $Al_2O_3$. For $MnO/SiO_2$ ratios above 0.9, it may be theoretically possible to operate with negligible $Al_2O_3$ content. However, as previously explained, the $MnO/SiO_2$ ratios actually obtained in a commercial plant can vary from the theoretical, calculated expected values and can change at various locations through the strip caster. Moreover the melting point can be very sensitive to minor changes in this ratio. Accordingly it is desirable to control the $Al_2O_3$ level to produce an $Al_2O_3$ content of at least 3% for all silicon manganese killed low carbon steels.

The solidification inclusions formed at the meniscus level of the pool on initial solidification become localized on the surface of the final strip product and can be removed by scaling or pickling. The deoxidation inclusions on the other hand are distributed generally throughout the strip. They are coarser than the solidification inclusions and are generally in the size range 2 to 12 microns. They can readily be detected by SEM or other techniques.

Figure 10:
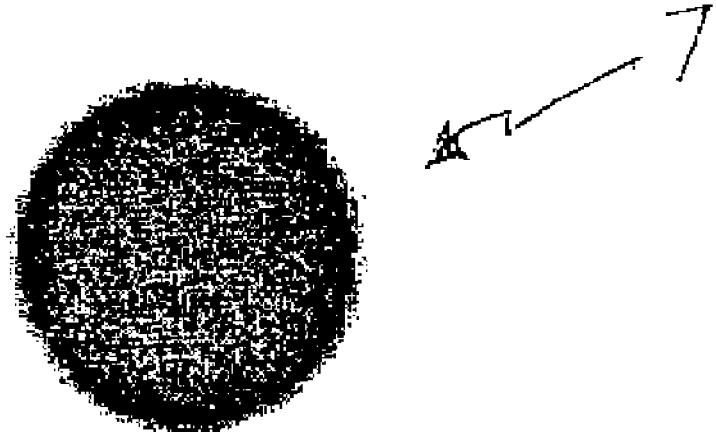
FIG. 10 is a micrograph of an illustrative $MnO.SiO_2.Al_2O_3$ inclusion of 9.3 microns in diameter.
Figure 11:
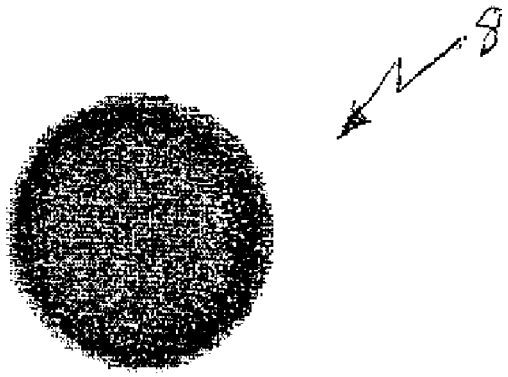
FIG. 11 is a micrograph of an illustrative $MnO.SiO_2.Al_2O_3$ inclusion of 5.6 microns in diameter.
Figure 12:
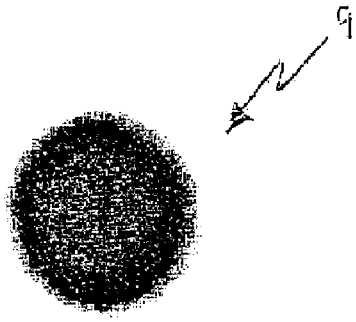
FIG. 12 is a micrograph of an illustrative $MnO.SiO_2.Al_2O_3$ inclusion of 4.1 microns in diameter.

FIGS. 10–12 are SEM micrographs of illustrative $MnO.SiO_2.Al_2O_3$ inclusions from one heat showing the measured inclusion size. Each micrograph represents a 61×500 μm section of strip 20 magnified to show $MnO.SiO_2.Al_2O_3$ inclusions 7, 8, and 9, respectively. The magnification and scale of the micrograph is shown on each Figure. $MnO.SiO_2.Al_2O_3$ inclusion 7 has a diameter of about 9.3 microns, $MnO.SiO_2.Al_2O_3$ inclusion 8 has a diameter of about 5.6 microns, and $MnO.SiO_2.Al_2O_3$ inclusion 9 has a diameter of about 4.1 microns.

Figure 13:
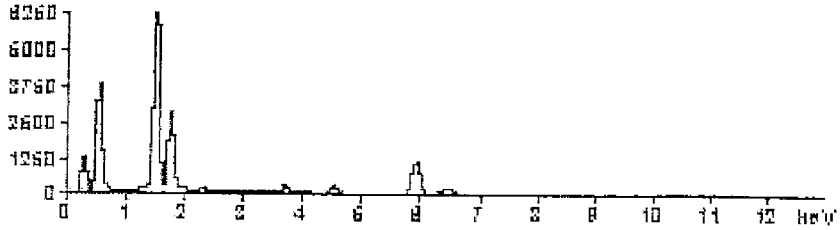
FIG. 13 is an x-ray spectrum of the illustrative $MnO.SiO_2.Al_2O_3$ inclusion of FIG. 10.
Figure 14:
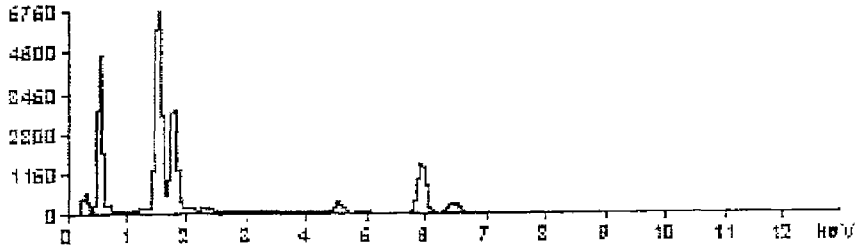
FIG. 14 is an x-ray spectrum of the illustrative $MnO.SiO_2.Al_2O_3$ inclusion of FIG. 11.
Figure 15:
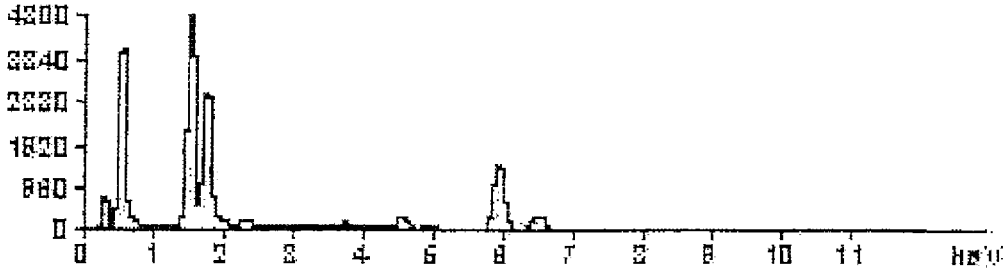
FIG. 15 is an x-ray spectrum of the illustrative $MnO.SiO_2.Al_2O_3$ inclusion of FIG. 12.

By bombarding the illustrative $MnO.SiO_2.Al_2O_3$ inclusions 7, 8, 9 with an electron beam, x-rays are emitted from the inclusions thereby creating respective spectra as shown in FIGS. 13–15. The x-axis of the spectra shows the x-ray energy in Kev and the y-axis shows the number of counts measured at the different energy levels over the x-ray energy spectra. Because each oxide in the inclusion has a signature x-ray emission characteristic over the spectrum, the composition of each inclusion 7, 8, 9 may be determined, after taking into account atom interaction corrections familiar to those skilled in the art.

For $MnO.SiO_2.Al_2O_3$ inclusion 7 of FIG. 10 of 9.3 microns in diameter, the corresponding histogram FIG. 13 shows the oxide composition and oxide distribution of the inclusion to be:

| Oxide | Measured Percent by Wt. | Normalized Percent by Wt. |
|---|---|---|
| MgO | 1.06 | 1.11 |
| $Al_2O_3$ | 41.13 | 43.19 |
| $SiO_2$ | 26.91 | 28.26 |
| SO | 0.82 | 0.86 |
| CaO | 1.61 | 1.69 |
| $TiO_2$ | 1.17 | 1.23 |
| MnO | 21.19 | 22.25 |
| FeO | 1.30 | 1.37 |
| Total | | 99.96 |

For $MnO.SiO_2.Al_2O_3$ inclusion 8 of FIG. 11 of 5.6 microns in diameter, the corresponding histogram FIG. 14 shows the oxide composition and oxide distribution to be:

| Oxide | Measured Percent by Wt. | Normalized Percent by Wt. |
|---|---|---|
| MgO | 0.65 | 0.68 |
| $Al_2O_3$ | 38.02 | 39.92 |
| $SiO_2$ | 27.32 | 28.69 |
| SO | 0.73 | 0.77 |
| CaO | 0.34 | 0.36 |
| $TiO_2$ | 1.15 | 1.21 |
| MnO | 25.11 | 26.37 |
| FeO | 1.70 | 1.79 |
| Total | | 99.79 |

For $MnO.SiO_2.Al_2O_3$ inclusion 9 of FIG. 12 of 4.1 microns in diameter, the corresponding histogram FIG. 14 shows the oxide composition and oxide distribution of the inclusion to be:

| Oxide | Measured Percent by Wt. | Normalized Percent by Wt. |
|---|---|---|
| MgO | 0.35 | 0.38 |
| $Al_2O_3$ | 32.54 | 35.14 |
| $SiO_2$ | 28.26 | 30.52 |
| SO | 0.70 | 0.76 |
| CaO | 0.56 | 0.60 |
| $TiO_2$ | 1.07 | 1.16 |

-continued

| Oxide | Measured Percent by Wt. | Normalized Percent by Wt. |
|---|---|---|
| MnO | 26.35 | 28.46 |
| FeO | 2.69 | 2.91 |
| Total | | 99.93 |

These measurements show that inclusions 7, 8 and 9 have $Al_2O_3$ content less than about 45% and are of different sizes between 2 and 12 microns in diameter. Also, the measured ratios of these $MnO/SiO_2$ illustrative $MnO.SiO_2.Al_2O_3$ inclusions is 0.79 for inclusion 7, 0.92 for inclusion 8 and 0.93 for inclusion 9.

Although the invention has been illustrated and described in detail in the foregoing drawings and description with reference to several embodiments, it should be understood that the description is illustrative and not restrictive in character, and that the invention is not limited to the disclosed embodiments. Rather, the present invention covers all variations, modifications and equivalent structures that come within the scope and spirit of the invention. Additional features of the invention will become apparent to those skilled in the art upon consideration of the detailed description, which exemplifies the best mode of carrying out the invention as presently perceived. Many modifications may be made to the present invention as described above without departing from the spirit and scope of the invention.

What is claimed is:

1. A cast low carbon steel strip made by a method comprising the steps of:

assembling a pair of casting rolls forming a nip between the rolls;

forming a molten steel having a slag of iron, manganes, silicon and aluminum oxides producing in a steel strip $MnO.SiO_2.Al_2O_3$ inclusions having a ratio of $MnO/SiO_2$ in the range of 0.2 to 1.6 and $Al_2O_3$ content of at least 3% and less than 45%;

introducing the molten steel between the pair of casting rolls to form a casting pool of molten steel supported on casting surfaces of the rolls above the nip; and counter rotating the casting rolls to produce a solidified steel strip delivered downwardly from the nip between the casting rolls.

2. The cast low carbon steel strip of claim 1 wherein the $Al_2O_3$ content is up to a percentage of 35+2.9 (R−0.2), where R is the $MnO/SiO_2$ ratio of the inclusions.

3. The cast low carbon steel strip of claim 1 wherein the $Al_2O_3$ content of the $MnO.SiO_2.Al_2O_3$ inclusions is in the range 10% to 30%.

4. The cast low carbon steel strip of claim 1 wherein $MnO.SiO_2.Al_2O_3$ inclusions are dispersed through the strip.

5. The cast low carbon steel strip of claim 1 wherein the majority of $MnO.SiO_2.Al_2O_3$ inclusions range in size from 2 to 12 microns in diameter.

* * * * *